US007396987B1

(12) United States Patent
Tentindo

(10) Patent No.: US 7,396,987 B1
(45) Date of Patent: Jul. 8, 2008

(54) PORTABLE KEYBOARD MUSICAL INSTRUMENT

(76) Inventor: Charles A. Tentindo, 1140 E. Ocean Blvd., #133, Long Beach, CA (US) 90802-6524

( * ) Notice: Subject to any disclaimer, the term of this patent is extended or adjusted under 35 U.S.C. 154(b) by 127 days.

(21) Appl. No.: 11/278,726

(22) Filed: Apr. 5, 2006

(51) Int. Cl.
*G10C 3/12* (2006.01)
*G10C 3/02* (2006.01)
*G10H 1/32* (2006.01)

(52) U.S. Cl. ..... 84/423 R; 84/425; 84/429; 84/718; 84/719; D17/1; D17/2

(58) Field of Classification Search ..... 84/420, 84/376 K, 423 R, 425, 429, 718, 719; D17/1, D17/2
See application file for complete search history.

(56) References Cited

U.S. PATENT DOCUMENTS 1,790,476 A * 1/1931 Johnson ..... 248/151
2,796,796 A * 6/1957 Bolle ..... 84/355
3,335,629 A * 8/1967 Brodin ..... 84/1
3,589,062 A * 6/1971 Desmond et al. ..... 446/405
3,857,343 A * 12/1974 Greenberg ..... 108/133
D245,197 S * 7/1977 Noury, Jr. ..... D17/1
4,126,070 A * 11/1978 Hill ..... 84/718
D254,496 S * 3/1980 Hill ..... D17/1
D255,803 S * 7/1980 Leal ..... D17/2
D256,366 S * 8/1980 Dworsky ..... D17/1
D261,150 S * 10/1981 Terry, Jr. ..... D17/2
4,304,167 A * 12/1981 Tait ..... 84/429
4,352,310 A * 10/1982 Orlandoni ..... 84/718
D278,066 S * 3/1985 Garoogian ..... D17/1
D278,154 S * 3/1985 Baker ..... D17/9
4,545,276 A * 10/1985 Curletto ..... 84/600
4,570,521 A * 2/1986 Fox ..... 84/653
4,634,090 A * 1/1987 Currie et al. ..... 248/544
D296,338 S * 6/1988 Sgroi ..... D17/1
4,760,984 A * 8/1988 Hennessey ..... 248/121
D310,090 S * 8/1990 Stone et al. ..... D17/2
4,953,436 A * 9/1990 Curletto ..... 84/376 A
4,988,150 A * 1/1991 Lindow et al. ..... 312/351.3
5,099,737 A * 3/1992 Curletto ..... 84/376 R
D326,969 S * 6/1992 Eason et al. ..... D6/455

(Continued)

OTHER PUBLICATIONS

U.S. Appl. No. 29/256,679, filed Mar. 23, 2006, Charles A. Tentindo.

*Primary Examiner*—Lincoln Donovan
*Assistant Examiner*—Robert W Horn
(74) *Attorney, Agent, or Firm*—Klein, O'Neill & Singh, LLP

(57) ABSTRACT

A versatile portable keyboard musical instrument has a number of separable portions including a first keyboard portion detachable from a second supporting base portion for use alone, or the second supporting base portion may be removed from a support stand and the first portion to enable the musical instrument to be easily transported and played by a musician in any desired manner or position, such as vertically, horizontally, at an angle, or while standing, sitting down or moving across a stage or floor. The keyboard musical instrument includes cavities for insertion of a wireless MIDI device, various finger control devices, an electrical power source or adapters to be connected to a power source, to enable the instrument to be used without cables. Each of the different portions is sized and shaped with open areas or spaces for artistic appearance, to lessen the weight thereof and to serve as carrying handles.

20 Claims, 5 Drawing Sheets

U.S. PATENT DOCUMENTS 5,248,843 A * 9/1993 Billings ..... 84/609
5,271,386 A * 12/1993 Thompson ..... 601/102
D349,127 S * 7/1994 Nelson ..... D17/1
5,359,461 A * 10/1994 Rice et al. ..... 359/874
D355,923 S * 2/1995 Slater ..... D17/1
D355,924 S * 2/1995 Slater ..... D17/1
5,388,493 A * 2/1995 Curletto ..... 84/376 A
5,434,350 A * 7/1995 Haney et al. ..... 84/743
5,463,925 A * 11/1995 Galocy ..... 84/423 R
5,497,965 A * 3/1996 Mathieu, Jr. ..... 248/159
D389,876 S * 1/1998 Leung ..... D21/409
5,731,532 A * 3/1998 Slaby ..... 84/376 A
5,760,323 A * 6/1998 Romero et al. ..... 84/470 R
6,101,086 A * 8/2000 Kim et al. ..... 361/683
6,274,800 B1 * 8/2001 Gardner ..... 84/644
6,329,582 B1 * 12/2001 Catalano, Jr. ..... 84/385 R
D475,995 S * 6/2003 Hsieh ..... D14/229
6,740,800 B1 * 5/2004 Cunningham ..... 84/423 R
6,842,168 B1 * 1/2005 Sim et al. ..... 345/156
6,875,913 B2 * 4/2005 Bubar ..... 84/423 R
7,034,219 B2 * 4/2006 Koo ..... 84/745
7,176,366 B1 * 2/2007 Bruce ..... 84/327
2003/0110926 A1 * 6/2003 Sitrick et al. ..... 84/477 R
2007/0023606 A1 * 2/2007 Zimmermann ..... 248/523

* cited by examiner

PORTABLE KEYBOARD MUSICAL INSTRUMENT

BACKGROUND OF THE INVENTION

1. Field of the Invention

This invention generally relates to musical instruments and, more particularly, to an improved portable keyboard musical instrument having separable keyboard playing and supporting base portions removably held in a support stand, as well as one or more carrying handles in a uniquely designed device that allow it to be readily supported or transported and easily played in a various positions, wired or wirelessly, to provide a variety of sounds limited only by the players ability and any electronics utilized through MIDI wired and wireless interfaces.

2. Description of the Prior Art

Currently available keyboard musical instruments have generally oval or rectangular housings, are not easily supported or held while moving, nor do they provide an attractive appearance. Additionally, some of the available keyboard musical instruments have keyboards that may be folded or rolled for storage and/or transport, but which must be unfolded or unrolled and placed on a flat supporting stand or surface before they may be played.

Moreover, for many reasons, including the fact that they are not attractive or easy to transport or use, the available keyboards are widely rejected by musicians and others in the music industry, or are too expensive for many musicians.

Therefore, there exists a need in the art for a portable keyboard musical instrument that is attractive, easy to transport and which may be used in a number of ways and substantially any position, such as vertically or horizontally, any place on a stage or within a defined area to add to the stage presence and versatility of a performer or a performance, while producing a full variety of sounds.

SUMMARY OF THE INVENTION

Accordingly, it is a general object of the present invention to provide an improved portable keyboard musical instrument device. It is a more particular object of the present invention to provide an improved portable keyboard musical instrument device that may be selectively supported in a stand and played in horizontal or vertical position. It is a more particular object of the present invention to provide an improved portable keyboard musical instrument device having at least one leg removably held in a stand and separably mounted on a keyboard holding portion. It is a further object of the present invention to provide an improved portable keyboard musical instrument device having separable supporting base and keyboard playing portions connected by a registration element. It is yet another object of the present invention to provide an improved portable electronic keyboard musical instrument device having separable supporting base and keyboard playing portions that may be selectively held together and in a support stand and which includes sufficient controls and MIDI modules to play a wide variety of music.

In accordance with one aspect of the present invention there is provided a portable keyboard musical instrument having a first keyboard playing portion and a second supporting base removably attached to the first portion. The supporting base has at least one leg adapted for insertion into and removal from a support stand. The support stand, if used, may have a means for securing the at least one leg therein, including a release to allow the at least one leg to be removed from the support stand.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
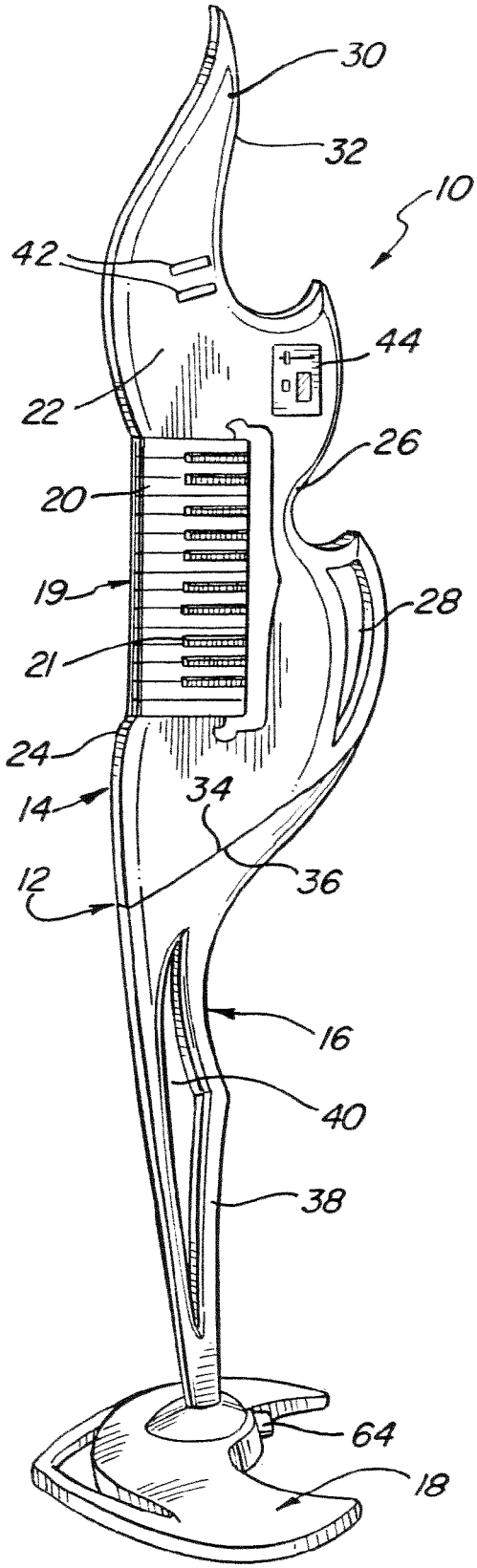
FIG. 1 is a front perspective view of a portable keyboard musical instrument of the present invention held in a vertical position in a support stand.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel, improved and versatile portable keyboard musical instrument having a number of parts or portions to enable the musical instrument to be easily transported and played by a musician in any desired manner or position, such as vertically, horizontally or at an angle, or while standing, sitting down or moving across a stage or floor. The novel and versatile portable keyboard is made to resemble an artistic sculpture, thereby providing a collectible item. Furthermore, the integration of a wireless MIDI transmitter allows this to occur without the need for cables, thereby improving its overall appearance and usefulness.

The improved portable keyboard musical instrument of the present invention may include control devices, an electrical power source or adapters to be connected to a power source, and electronic components, including MIDI modules, for connection to or operation of various external devices. The keyboard may be held vertically and pivoted in different directions or spun around 360°, or it may be swiveled on its axis from about 45° to about 90°. The keyboard may be left in a vertical position in a support stand. A first keyboard portion may be quickly and easily detached from a second base portion for use alone, or the second base portion may be left on the first portion during play. The first and second portions of the portable keyboard musical instrument of the present invention are provided with open areas or spaces to lessen the weight thereof and for ease in handling, lifting and transporting and to provide a unique and aesthetically pleasing coordinated design.

Turning now to the drawings, there shown is a presently preferred embodiment of an improved portable keyboard musical instrument of the present invention, generally indicated at 10. The portable keyboard 10 has a body 12 comprised of a first or top keyboard portion or section 14 removably held in a second or bottom base or supporting portion or section 16. The portable keyboard musical instrument 10 is shown held in a vertical position in a support stand 18.

Figure 5:
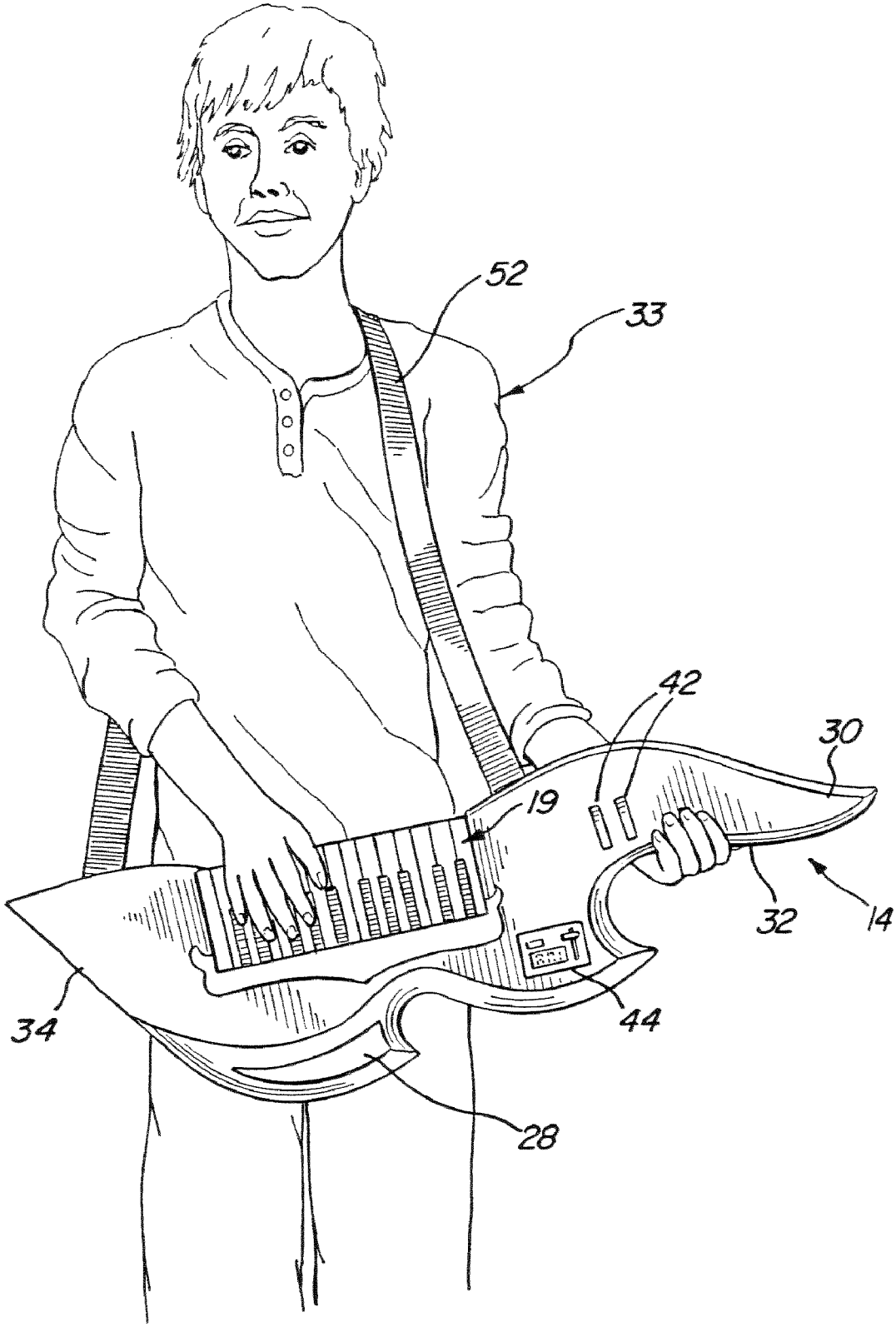
FIG. 5 is a perspective view of a musician holding the first or top keyboard portion in a playing position and having an optional shoulder strap held to the rear of the keyboard portion and suspended over the musician's shoulder.

In the currently preferred embodiment of the invention, as shown in the drawings, the first or top keyboard portion 14 includes a keyboard area 19 having a plurality of black keys 20 and white keys 21, held in a front face 22 thereof along a first side edge 24. An opposite or second side edge 26 includes an open area or carrying handle 28 to add artistically to the looks thereof, lessen the weight of the portion 14 and to enable it to be easily carried. The first or top keyboard portion 14 may include one or more speakers. An outer end 30 of the first or top keyboard portion 14 is preferably formed in a pleasing, sculptured shape for added artistic appeal and to serve as a handle or holding portion 32 for a hand of a musician 33, as best shown in FIG. 5. An inner or lower end 34 includes one or more securing elements for holding, securing or supporting the top keyboard portion 14 on one or more mating elements on a complementary upper end 36 of the second or bottom base or supporting portion 16, as explained more fully below.

The second or bottom base or supporting portion 16 includes one or more supporting legs, such as 38, for insertion into and holding by one or more cooperating openings in the support stand 18, as explained more fully below. The one or more legs or supports 38 include one or more openings, such as 40 formed therein, for aesthetic/artistic purposes, to lighten the weight of the base 16 and/or to be used as a handle to carry the base alone or to aid in carrying or holding the keyboard portion 14, when connected thereto.

Figure 2:
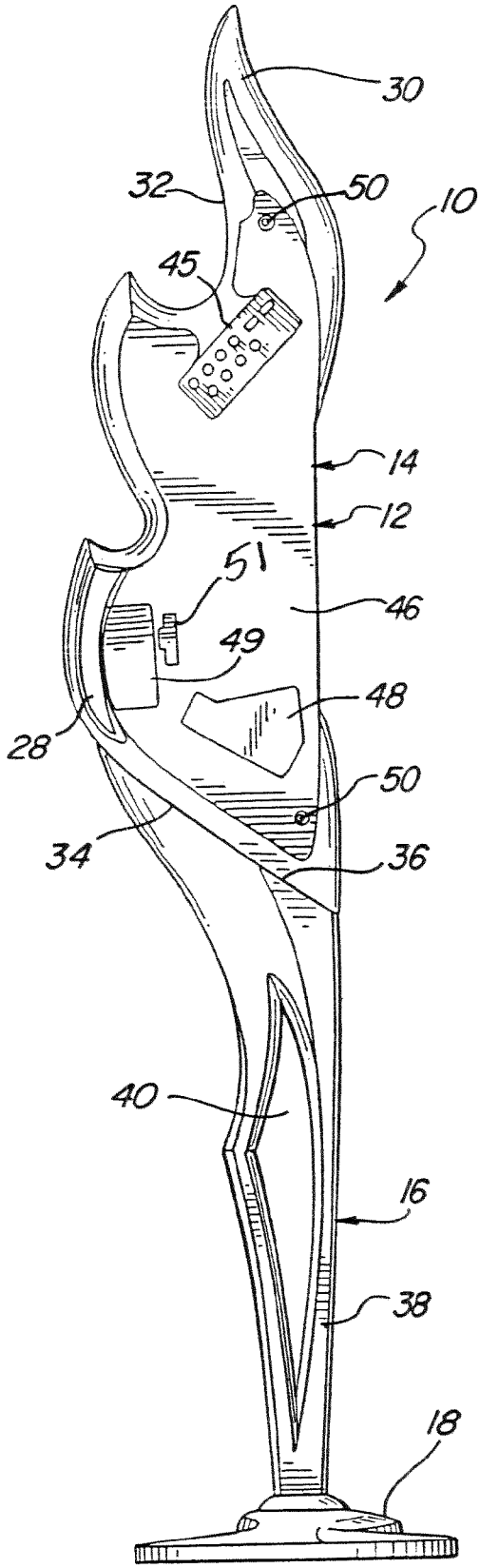
FIG. 2 is a rear elevational view of FIG. 1.
Figure 3:
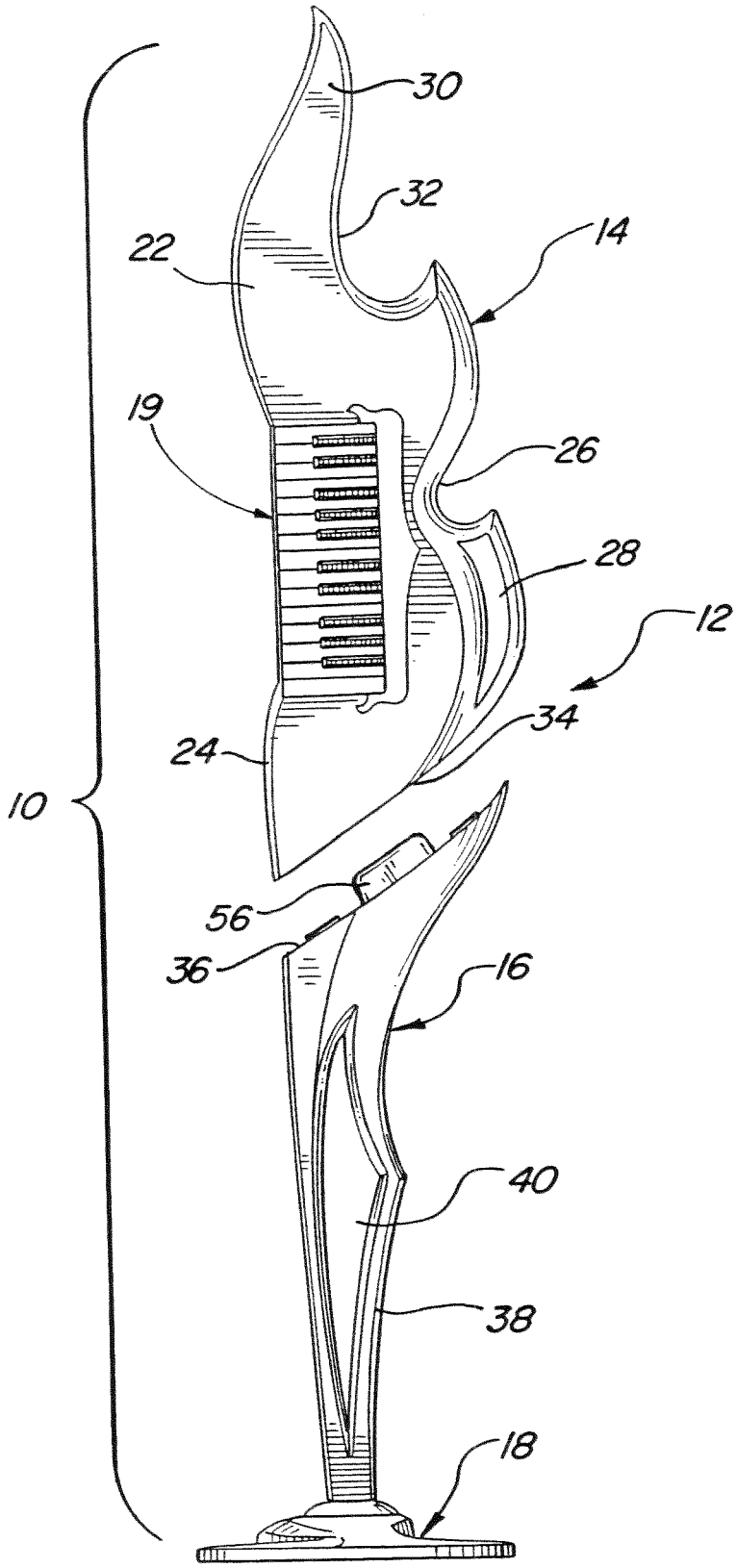
FIG. 3 is an exploded front elevational view of the portable keyboard of the present invention, with a first or top keyboard portion removed from a second or bottom supporting base portion held in a vertical position in a support stand.

The first or top keyboard portion 14 also may include controls, such as modulation and note bending wheels 42 and finger controls 44 mounted in the front surface 22. The finger controls 44 may be for volume and sound patches and may include one or more displays. The rear surface 46 may have further finger or thumb controls 45, for octave jumping and/or input or output connections. Furthermore, the rear surface 46 may have one or more cavities 48, 49, 51 covered by panels, if desired, to hold MIDI and/or other electronic controls and to hold batteries and/or allow an AC/DC adapter to be used. Optional strap holding connections 50 may be included on the rear surface 46 to allow an optional shoulder strap 52 to be secured to the rear surface (see FIGS. 2 and 5). The modulation and note bending wheels 42 and the finger controls 44 on the front surface 22 and the finger or thumb controls 45, for octave jumping on the rear surface 46 are ergonomically placed and sized and positioned so as to be easily reached and used by a musician holding the first section 12 in any playing position, such as shown in FIG. 5.

Figure 4:
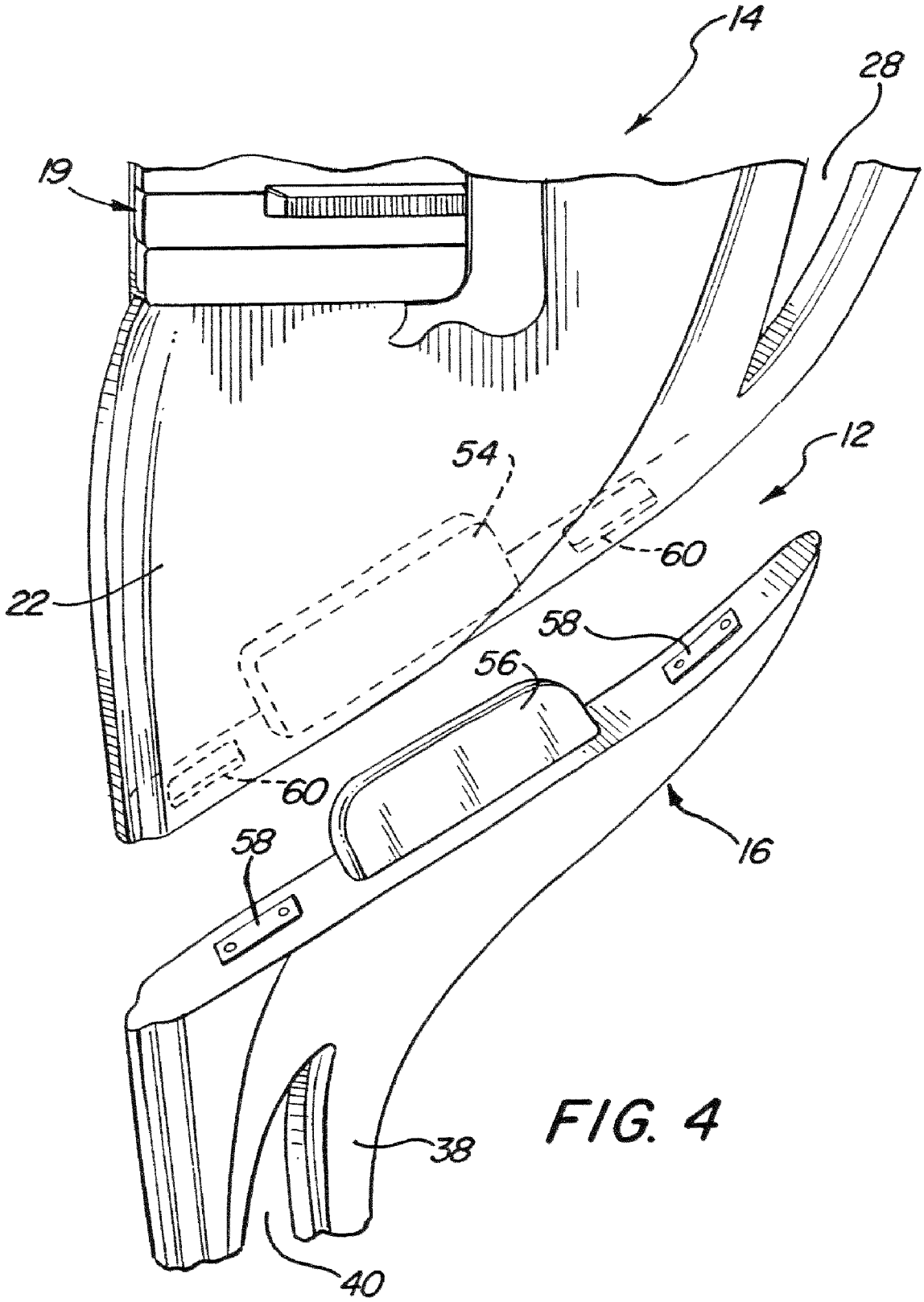
FIG. 4 is an enlarged partial perspective view of the separable joints for the first and second portions of the portable keyboard musical instrument.

Turning now to FIG. 4, there shown is an enlarged partial view of the mating connection of the separable first and second portions 14, 16. The lower end 34 has a cavity or opening 54 formed therein for mating engagement with a fin, protruding element or registration portion 56 formed on or secured to the upper end 36 of the second portion 16. The fin, protruding element or registration portion 56 may be loosely or frictionally held in the opening 54 to hold the first and second portions together, either when they are held vertically in the support stand 18 or when removed from the support stand. Further cooperating holding or securing elements, such as metal plates 58 and magnets 60 may be secured to the ends 34, 36 to aid in releasably holding the first and second portions together. The ends 34, 36 may be formed so as to be substantially straight, or they may be provided with a slight curvature as shown in the drawings.

Figure 6:
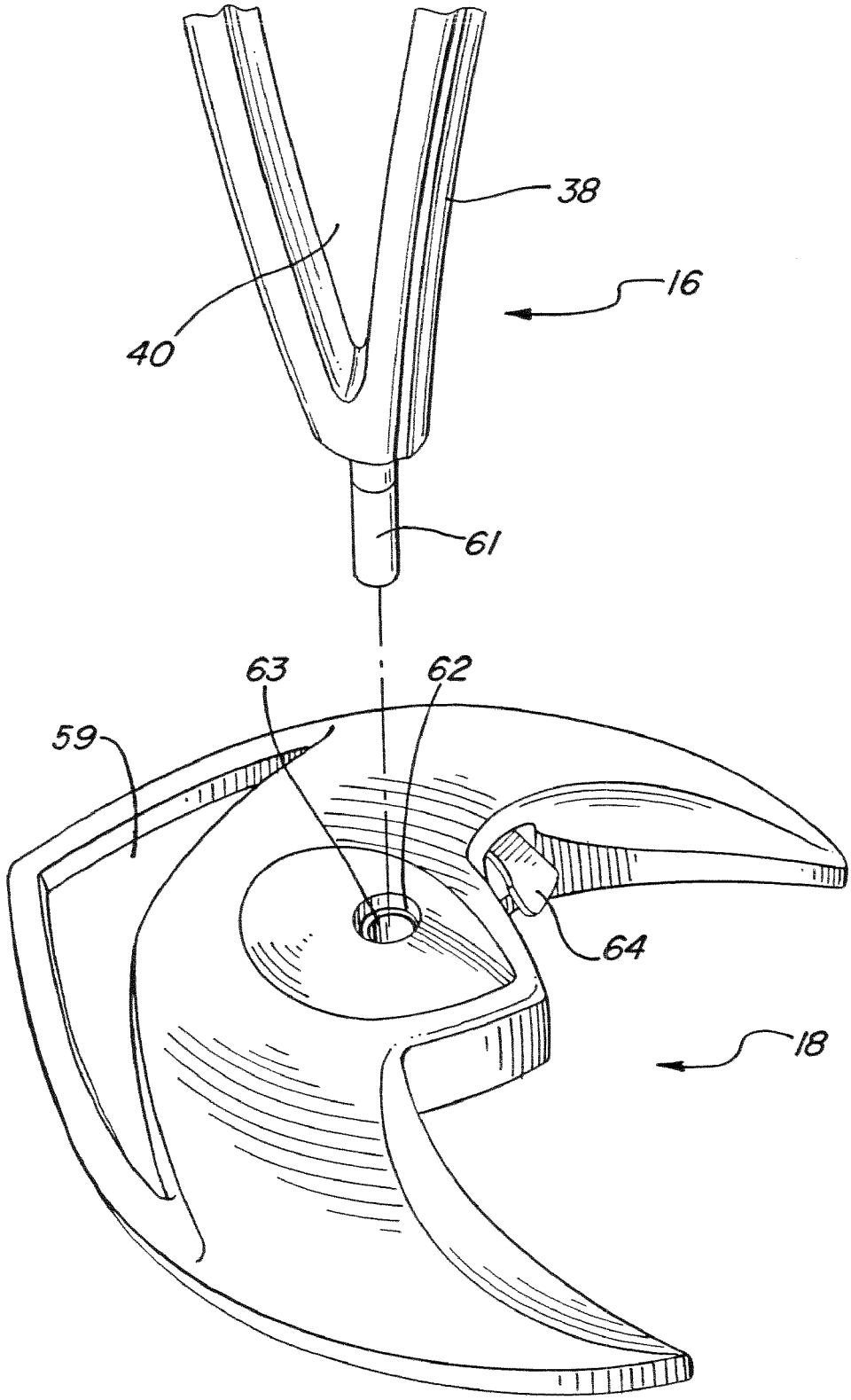
FIG. 6 is an enlarged partial perspective view of a lower leg or portion of the second or bottom supporting base in position over the support stand for insertion into or after removal from an opening in the support stand.

As best shown in FIG. 6, the support stand 18 includes an opening 59 to lessen its weight and provide a carrying handle for the support base. A lower end 61 of the at least one leg 38 is reduced in size and formed so as to be substantially cylindrical so as to be insertable into and removably held in at least one aperture 62 formed in support stand 18. The substantially cylindrical lower end 61 may be frictionally held in the aperture 62, or may be firmly held therein by an internally held holding element 63, such as a magnet or clamp, operable between open and locked positions by an operating member, such as a latch or finger 64, movably mounted in the support base 18. It is to be understood that the invention also covers a lower portion 61 that may have openings or other means whereby it could be attached to or held by the support stand 18 and hold the second portion 14 and first portion 12 in a vertical position, without requiring an aperture formed in the support stand.

It, therefore, can be seen that the present invention provides an improved portable keyboard musical instrument comprised of a number of separable parts that enable the keyboard to be played in a wide variety of positions. Additionally, because the parts are relatively light in weight, they may be easily assembled, disassembled, transported or used by most musicians in substantially any venue.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A portable keyboard musical instrument, comprising;

a two-piece body comprising a first keyboard section and a second separable supporting section; the first keyboard section and the second separable supporting section each having a first end, a second end, side edges, a planar front surface and a planar rear surface;

the first keyboard section having a keyboard on the planar front surface extending along a first side edge, an open area forming a handle on an opposed second side edge, a handle at the first end and a holding portion at the second end; and the second separable supporting section having an engaging portion at the first end and a reduced size second end whereby the reduced size second end may be inserted in a support and the engaging portion may be mated with the holding portion of the first keyboard section for supporting the portable keyboard musical instrument in a vertical position.

2. The portable keyboard musical instrument of claim 1 wherein the holding portion at the second end of the first keyboard section and the engaging portion at the first end of the second separable supporting section comprise a cavity and an opening and cooperating securing elements for releasably holding the first keyboard section and the second separable supporting section together.

3. The portable keyboard musical instrument of claim 1, further including a support stand having at least one aperture for removably holding the reduced size second end of the second separable supporting section in a vertical position relative to a supporting surface on which the support stand is held.

4. The portable keyboard musical instrument of claim 3 wherein the second separable supporting section has at least one leg with the reduced size second end at a lower portion thereof and the least one aperture has an internal securing element for removably holding the reduced size second end in the at least one aperture.

5. The portable keyboard musical instrument of claim 4, further including an operating member movably mounted in the support base to lock or unlock the reduced size second end of the at least one leg member in the at least one aperture formed in the support stand.

6. The portable keyboard musical instrument of claim 5 wherein the holding portion at the second end of the first keyboard section comprises an opening formed in the second end and the engaging portion at the first end of the second separable supporting section comprises a fin and the cooperating securing elements comprise metal plates and magnets.

7. The portable keyboard musical instrument of claim 1 wherein and a holding portion at the second end and the engaging portion at the first end comprise a registration fin held on the second end and an opening formed in the first end.

8. The portable keyboard musical instrument of claim 7, further including a support stand for removably holding the second separable supporting section in a vertical position relative to a supporting surface on which the support stand is held; the second separable supporting section having at least one leg; the at least one leg having the reduced size second end thereon; the reduced size second end being substantially cylindrical; the substantially cylindrical reduced size second end being removably held in at least one aperture formed in the support stand.

9. The portable keyboard musical instrument of claim 8, further including a movable holding element held in the at least one aperture to removably secure the substantially cylindrical reduced size second end of the at least one leg member and an operating member movably held in the support stand and connected to the movable holding element to lock and unlock the holding element on the substantially cylindrical reduced size second end.

10. The portable keyboard musical instrument of claim 1, further including a plurality of finger controls held on the planar front surface of the first keyboard section and positioned so as to be easily accessible by a left hand of a musician when holding the first keyboard portion.

11. The portable keyboard musical instrument of claim 1, further including a plurality of finger controls held on the planar front surface and planar rear surface of the first keyboard section; and wherein the planar rear surface has a plurality of cavities for holding electronic components.

12. A portable keyboard musical instrument, comprising;

a two-piece body having a first keyboard section and a second separable supporting section; each of the first keyboard section and the second separable supporting section having a first end, a second end, side edges, a planar front surface and a planar rear surface;

the first keyboard section having a keyboard held on the planar front surface extending along a first side edge, a handle formed on an opposed second side edge, a handle formed at the first end and a mating portion formed at the second end;

the second separable supporting section having a complementary mating portion at the first end and a reduced size second end; and a plurality of finger controls formed on the planar front surface of the first keyboard section and positioned so as to be easily accessible by a left hand of a musician when holding the first keyboard section.

13. The portable keyboard musical instrument of claim 12, further including a support stand having an aperture formed therein for removably supporting the reduced size second end of the second separable supporting section in a vertical position relative to a supporting surface on which the support stand is held; a leg formed on the second separable supporting section; the leg having the reduced size second end thereon; and wherein the reduced size second end is substantially cylindrical.

14. The portable keyboard musical instrument of claim 13 wherein the mating portion on the first keyboard section and the complementary mating portion on the second separable supporting section comprise a fin held on the first end of the second separable supporting section and an opening formed in the second end of the first keyboard section.

15. The portable keyboard musical instrument of claim 14, further including a plurality of openings formed in the first keyboard section, the second separable supporting section and the support stand, which plurality of openings lessen the weight, add to the visual appearance and may be used as carrying handles.

16. The portable keyboard musical instrument of claim 14 wherein the first keyboard section has a plurality of electronic controls held in the front planar surface and the rear planar surface to enable a musician to play a variety of sounds with the first keyboard section.

17. A portable keyboard musical instrument, comprising;

a two-piece body having a first keyboard section with a planar front surface having a keyboard on a first side edge, an opening forming a handle on an opposed second side edge, a planar rear surface, a first end formed in the shape of a handle and a second end having an opening formed therein for mating with a further section of the two-piece body;

the two-piece body having a second separable supporting section with a planar front surface, a planar rear surface, a first end having a fin formed thereon for mating with the first keyboard section and a substantially cylindrical reduced size second end;

a plurality of finger controls formed on the planar front surface and the planar rear surface of the first keyboard section and positioned so as to be easily accessible by a left hand of a musician when holding the first keyboard portion; and a support stand having an aperture formed therein for removably holding the substantially cylindrical reduced size second end of the second separable supporting section in a vertical position relative to a supporting surface on which the support stand is held.

18. The portable keyboard musical instrument of claim 17, further including a plurality of openings formed in the first keyboard section, the second separable supporting section and the support stand, which plurality of openings lessen the weight, add to the visual appearance and may be used as carrying handles.

19. The portable keyboard musical instrument of claim 17, further including a plurality of cavities formed in the planar rear surface of the first keyboard section, which cavities may be used for holding various electronic components.

20. The portable keyboard musical instrument of claim 17, further including a movable holding element held in the aperture in the support stand to removably secure the substantially cylindrical reduced size second end; and an operating member movably held in the support stand for controlling movement of the movable holding element.

* * * * *